US005706690A

United States Patent [19]

Connolly

[11] Patent Number: 5,706,690

[45] Date of Patent: Jan. 13, 1998

[54] TWIN STAND COLD REVERSING MILL

[75] Inventor: Richard S. Connolly, Pittsburgh, Pa.

[73] Assignee: Tippins Incorporated, Pittsburgh, Pa.

[21] Appl. No.: 798,790

[22] Filed: Feb. 12, 1997

Related U.S. Application Data

[63] Continuation of Ser. No. 397,382, Mar. 2, 1995, abandoned.

[51] Int. Cl.[6] ..... B21B 41/06; B21B 39/00

[52] U.S. Cl. ..... 72/229

[58] Field of Search ..... 72/205, 226, 229, 72/231, 234, 237, 252.5, 366.2

[56] References Cited

U.S. PATENT DOCUMENTS

| | | | |
|---|---|---|---|
| 372,747 | 11/1887 | Everson . | |
| 837,104 | 11/1906 | Norton . | |
| 1,964,503 | 6/1934 | Coryell | 80/33 |
| 2,025,002 | 12/1935 | McIlvried | 29/18 |
| 2,123,291 | 7/1938 | Smitmans | 80/33 |
| 3,331,232 | 7/1967 | King | 72/365 |
| 3,485,077 | 12/1969 | Wilson | 72/229 |
| 4,433,566 | 2/1984 | Tippins et al. | 72/234 |
| 4,497,191 | 2/1985 | Langer et al. | 72/202 |
| 4,580,428 | 4/1986 | Brettbacher et al. | 72/226 |
| 4,583,387 | 4/1986 | Thomas et al. | 72/229 |
| 5,142,891 | 9/1992 | Kuwano | 72/205 |
| 5,287,715 | 2/1994 | Kusaba | 72/366.2 |

FOREIGN PATENT DOCUMENTS

| | | |
|---|---|---|
| 2119957 | 9/1994 | Canada . |
| 56-59507 | 5/1981 | Japan . |
| 3-138004 | 6/1991 | Japan . |

OTHER PUBLICATIONS

McGannon, Harold E., Ed., *The Making, Shaping and Treating of Steel*, Eighth Edition, "Manufacture Of Cold--Reduced Flat-Rolled Products", Chapter 32, pp. 912–930, United States Steel Corporation, 1964.

*Primary Examiner*—Lowell A. Larson
*Assistant Examiner*—Rodney Butler
*Attorney, Agent, or Firm*—Webb Ziesenhiem Bruening Logsdon Orkin & Hanson, P.C.

[57] ABSTRACT

A cold rolling mill and method for cold rolling is disclosed. The cold rolling mill includes at least two tandem four-high reversing mills with at least one tension reel on each side of the tandem mills. Bridle roll units may be positioned on each side of the tandem, reversing mills to allow the cold rolling mill to be utilized as a temper mill.

25 Claims, 1 Drawing Sheet

TWIN STAND COLD REVERSING MILL

This application is a continuation of application Ser. No. 08/397,382 filed on Mar. 2, 1995, abandoned.

BACKGROUND OF THE INVENTION

1. Field of the Invention

The present invention relates to a method and apparatus for cold rolling metal. Specifically, the present invention provides a twin stand tandem, reversing cold rolling and temper mill and a method for utilizing the same to achieve high production capacity, improved yield and the ability to handle a variable product mix.

2. Prior Art

The cold reduction mills commercially available and/or in use are of several types. Historically, the bulk of cold reduced steel is rolled on continuous three to six stand four-high tandem mills. Conventionally, in each mill stand of a continuous multistand mill, the work roll and back roll diameters are on the order of 20 inches and 50 inches, respectively. Such continuous mills are nonreversing with the working rolls being driven and the requisite back tension being created by each preceding mill stand. These types of continuous, nonreversing mills require a significant amount of capital investment and additionally take up a significant amount of floor space.

In contrast to the continuous multistand nonreversing tandem mills, a single stand reversing cold mill is known in the art. The first example of such a mill is the Steckel mill which includes a four-high reversing mill employing working rolls which vary in diameter from 2–5 inches with backup rolls about six to eight times the working roll diameter. The Steckel mill utilizes two separately driven tension reels through which all of the power is provided. U.S. Pat. No. 2,025,002 to McIlvried discloses a single stand cold rolling reversing mill in which the roll diameter between the working roll and the backup roll is preferably 3:1. A significant difficulty in the operation of the known reversing mills is the amount of scrap material which is produced. In a single stand reversing cold mill, a significant amount of the strip at each end of the coil must be retained on the tension reel to supply the appropriate amount of back tension sufficient for cold rolling. This can result in scrap corresponding to about 20 feet per strip per coil at the product's original gauge. This limitation becomes significant where particularly costly materials are involved. A further limitation of the single stand reversing cold mill is the slower rolling rate as compared to a multistand continuous mill.

The cost of constructing a drive for a reversible mill has historically been higher than constructing a drive for a one-way mill. Consequently, the prior art has suggested the development of twin stand reversing mills in which one stand is configured to operate on the work in one direction while the other is held disengaged with the procedure reversed for the reversing direction. Examples of these machines can be found in U.S. Pat. Nos. 1,964,503 to Coryell and 3,485,077 to Wilson. In operation, these twin stand cold rolling mills present the same difficulties as the single stand cold reversing mills discussed above.

The object of the present invention is to overcome the aforementioned drawbacks of the prior art. It is a further object of the present invention to provide a cold rolling reversing mill which provides greater control over back tension, minimizing material losses at either end of the coil. A further object of the present invention is to provide a cost-effective method for cold reducing and tempering a wide product mix.

SUMMARY OF THE INVENTION

The objects of the present invention are achieved by providing a method of cold rolling metal, particularly steel, which includes providing at least two tandem four-high reversing mills with at least one tension reel on a first side of the tandem mill and at least one tension reel on a second side of the tandem mill. The metal is passed in a first pass from a tension reel on the first side through the tandem mills to a tension reel on the second side wherein each tandem mill reduces the metal during the pass such that the tandem mill operates in tandem during the pass. The metal is then passed in a second pass from the tension reel on the second side through the tandem mill to a tension reel on the first side wherein each tandem mill again reduces the metal during a subsequent pass, thereby operating in tandem. Additional passes may be utilized to further reduce the metal to a final thickness.

A payoff reel may be provided with the tension reel on the first side of the tandem mill. The provision of these two reels may be utilized to increase the speed of the overall cold rolling process. A payoff reel can be undergoing a setup procedure for working on a subsequent coil while the tension reel is being utilized in the reversing cold rolling operation.

The method of cold rolling according to the present invention may reduce the metal by at least one-third in the first pass, preferably reducing the metal between one-third and 55% in the first pass. The metal may be reduced at least 50% in the first two passes, preferably between 55–80% in the first two passes. For those materials requiring a third pass, the method according to the present invention may reduce the material between 80–95% in the third pass.

The method according to the present invention may further include the step of passing metal through the tandem mills in a separate campaign for a temper pass whereby the tandem mills will reduce the strip less than 10%, preferably up to about 3% for the temper pass. A bridle roll unit may be provided on each side of the temper rolls wherein the metal is passed through the bridle roll units on each temper pass.

The method of cold rolling according to the present invention can be repeated for a mix of metal products including, but not limited to, low carbon steel, medium carbon steel, high carbon steel, alloy, Si steel and stainless steel. The method according to the present invention can be utilized to cold roll and temper roll each of the products of the product mix whereby the tandem mills may cold roll in a given year about 240,000 tons of the product mix in about 4,623 hours, and the tandem mills can temper roll about 196,800 tons of the product mix in about 2,250 hours resulting in a total production of about 458,000 tons of product mix cold rolled and temper rolled in 7,200 hours, which is roughly a full year.

BRIEF DESCRIPTION OF THE PREFERRED EMBODIMENTS

Figure 1:
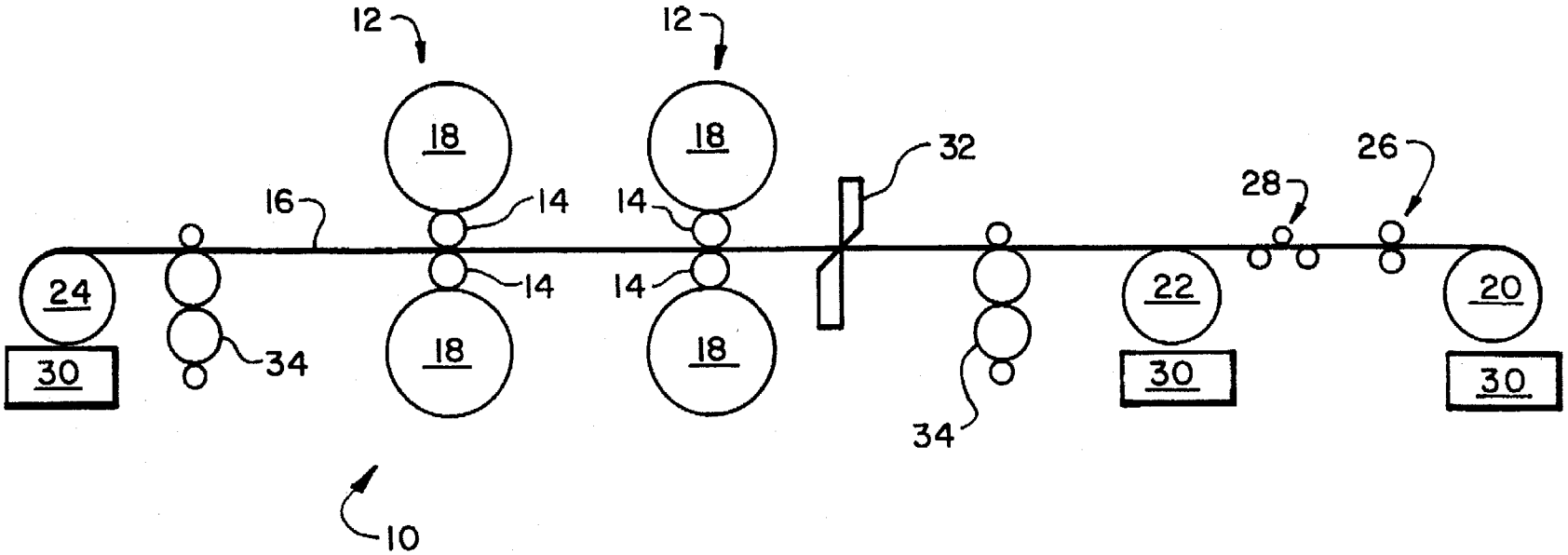
FIG. 1 is a schematic illustration of a reversing twin stand four-high cold rolling and temper mill according to the present invention.

FIG. 1 illustrates a tandem, reversing twin stand cold rolling and temper mill 10 schematically according to the present invention. The mill 10 includes two four-high reversing mill stands 12. Each reversing mill stand 12 includes two work rolls 14 positioned on either side of the pass line 16. Each work roll is 19–21 inches in diameter, preferably 21 inches, and has a working face or width of 56 inches and is formed of alloyed forged steel. Each reversing mill stand 12 includes a backup roll 18 positioned behind each work roll 14. Each backup roll is preferably between 49–53 inches in diameter, most preferably 53 inches, with a width of 56 inches and is also formed of alloy forged steel. It will be understood that the roll width is exemplary only as a product mix which includes wider cold rolled products which require a wider roll capability. Each reversing mill stand 12 is driven by a 6,000 horsepower motor assembly (not shown), preferably formed of two 3,000 horsepower submotors.

The mill 10 includes a payoff tension reel 20 and tension reel 22 on a first side of the reversing mill stands 12 and a tension reel 24 positioned on a second side of the reversing mill stands 12. Each reversing mill stand is a 20 inch diameter roll adapted to have the strip of material coiled thereon and paid-off to the reversing mill stands 12. Preferably, the payoff tension reel 20 is only utilized in the first pass feeding the strip of material from the payoff tension reel 20 through the reversing mill stands 12 to the tension reel 24 on the second side of the reversing mill stands. The second and subsequent passes through the reversing mill stands 12 will be between the tension reels 22 and 24 allowing the payoff tension reel to be utilized for setting up the subsequent coil to be rolled. With this operation in mind, the tension reels 22 and 24 are preferably each powered by a 2,000 horsepower motor (not shown) while the payoff tension reel 20 is powered by a 600 horsepower motor (not shown).

In the first pass, the strip of material will be fed from the payoff tension reel 20 through pinch rolls 26, the three roll flattener 28, the reversing mill stands 12 and onto the tension reel 24. Each roll of the three roll flattener 28 is preferably an 8 inch diameter roll with a 56 inch width made from solid steel. Each of the pinch rolls 26 is preferably a 10 inch diameter pinch roll with a 56 inch width formed from hardened alloy steel. Both the pinch rolls 26 and the three roll flattener 28 are preferably driven from a single 75 horsepower motor (not shown).

A coil car 30 is provided adjacent each reel 20, 22 and 24 for conveying appropriate coil material to and from the mill 10. Each coil car 30 preferably has a capacity of 60,000 pounds.

An upcut dividing shear 32 is provided adjacent the reversing mill stands 12 to allow for severing of the individual coils into smaller coil lengths as needed during rolling operations.

To operate the mill 10 as a temper mill, a pair of bridle roll units 34 is provided on each side of the reversing mill stands 12 between the reversing mill stands 12 and the tension reels 22 and 24, respectively, as shown in FIG. 1. Each bridle roll utilizes a pair of 44 inch diameter rolls having a 56 inch width and preferably powered by a 400 horsepower motor (not shown).

In operation, the mill 10 can operate as follows. The coil of metal, preferably steel, to be rolled is supplied to the payoff tension reel 20 by coil car 30 and fed through pinch rolls 26, the three roll flattener 28 and to the reversing mill stands 12 for a first pass along pass line 16. Each of the reversing mill stands 12 will reduce the metal during the first pass whereby the reversing mill stands 12 operate in tandem during the first pass. The controls are known multistand rolling mill synchronized controls now applied to a tandem stand cold mill. From the reversing mill stands 12, the material will be coiled on tension reel 24. After the first pass, the material to be cold rolled will be passed from the tension reel 24 through the reversing mill stands 12 along the pass line 16 to the tension reel 22. Each of the reversing mill stands 12 will again operate to cold reduce the workpiece whereby the reversing mill stands are operating in tandem during the second pass. Subsequent passes, if needed, will occur between the tension reels 22 and 24 through the reversing mill stands 12. While the second and subsequent passes are occurring between the tension reels 22 and 24, the payoff tension reel 20 can be loaded with the next coil to be worked. After the final pass, the workpiece can be carried to subsequent processing or storage by the coil car 30 adjacent the appropriate tension reel 22 or 24. It is also anticipated that if the mill 10 is positioned inline with subsequent processing that an additional tension reel can be provided on the second side of the reversing mill stands 12 adjacent tension reel 24 to allow for simultaneous pay off to downstream processing.

When utilizing the mill 10 for temper passes of a work product, the particular product will also be passed through each of the bridle roll units 34 to better control the tension of the thinner gauges during the tempering pass. Because cold reduction is carried out with rolling lubricants and temper rolling generally is not, the tandem mill must be cleaned prior to use as a temper mill. In addition, different roll surfaces are required for different end product; therefore, roll changes are required. This all necessitates that the cold reduction and temper rolling be carried out in separately scheduled campaigns. In other words, a given tonnage and product mix is cold reduced in a first campaign, the tandem mill is then cleaned and converted to include temper rolls and a second campaign of a given tonnage and product mix is scheduled for temper rolling. In a temper rolling mode, the two mills are not operated as reversing mills and, depending on the final product surface and temper requirements, one or both of the mills may be operated to provide the temper pass. Where both mills are operated in a temper pass, different roll surfaces may be used on each mill.

The present mill can provide several distinct advantages over the prior art. The provision of two tandem, reversing mill stands 12 allows for greater control of the back tension required for cold rolling the steel. This ability to better control the back tension with the tandem rolling stands can allow for a decrease in the amount of scrap material previously provided on some reversing mills. The present mill 10 additionally improves the processing time of previous reversing mills. The following Comparison Chart utilizes a simplified product mix to compare the twin stand cold reversing mill of the present invention with a single stand cold reversing mill and a six stand nonreversing cold continuous mill of the prior art. The advantages of easily rolling a significant amount of product are illustrated; however, some of the advantages of the present invention are not adequately illustrated with the narrow product mix chosen for the comparison.

COMPARISON CHART

| MILL | PRODUCT | GAUGE (INCHES) IN | GAUGE (INCHES) OUT | TPH (@ 75%) | TONS/YEAR (18 TURNS × 8 HRS. × 50 WKS. = 7,200 HRS./YEAR) |
|---|---|---|---|---|---|
| Single Stand Reversing | Sheet | .100 | .0393 | 54 | TOTAL 320,980 |
| | Tin Plate | .070 | .007 | 23 | |
| | Temper | | | | |
| | (Double Pass) | .007 | .006895 | 64 | |
| | (Single Pass) | .022 | .02134 | 91 | |
| Twin Stand Reversing | Sheet | .100 | .0393 | 83 | TOTAL 506,271 |
| | Tin Plate | .070 | .007 | 35 | |

-continued

COMPARISON CHART

| MILL | PRODUCT | GAUGE (INCHES) IN | GAUGE (INCHES) OUT | TPH (@ 75%) | TONS/YEAR (18 TURNS × 8 HRS. × 50 WKS. = 7,200 HRS./YEAR) |
|---|---|---|---|---|---|
| | Temper | | | | |
| | (Double Pass) | .007 | .006895 | 68 | |
| | (Single Pass) | .022 | .02134 | 91 | |
| Six Stand Tandem Nonreversing | Sheet | .100 | .0393 | 181 | TOTAL 926,045 |
| | Tin Plate | .070 | .007 | 60 | |
| | Temper | — | — | — | |

The present mill 10 provides the versatility of reversing mills over expensive continuous multistand nonreversing tandem cold mills. The present mill 10 allows for rolling of a wide product mix in both cold rolling and temper rolling operations. The wide mix and capabilities of the present mill 10 are illustrated by the following Examples.

The following Example illustrates a more realistic, proposed product mix for the mill 10 utilized for both cold rolling and temper rolling of the products. The schedule assumes a two minute delay between temper coils and a 75% operating efficiency. For reference purposes, a conventional work year can be considered as 18 shifts per week, 8 hours per shift, 50 weeks per year, for a total of 7,200 hours per year.

| GRADE | ROLLING SCHEDULE EXAMPLE # | THICKNESS IN (IN.) | THICKNESS OUT (IN.) | WIDTH (IN.) | TONS/ HOUR @ 75% EFFICIENCY | TONS/ YEAR | HOURS/ YEAR |
|---|---|---|---|---|---|---|---|
| COLD ROLLING: | | | | | | | |
| LOW CARBON | II | .070 | .007 | 40.0 | 35.0 | 48,000 | 1,371 |
| LOW CARBON | III | .077 | .013 | 41.4 | 52.0 | 88,800 | 1,708 |
| MEDIUM CARBON | IV | .074 | .017 | 36.0 | 60.0 | 36,000 | 600 |
| HIGH CARBON | V | .078 | .022 | 27.8 | 56.0 | 24,000 | 428 |
| ALLOY | VI | .094 | .035 | 30.8 | 71.0 | 9,600 | 135 |
| Si | VII | .113 | .049 | 37.0 | 98.0 | 4,800 | 50 |
| STAINLESS STEEL | VIII | .113 | .046 | 33.0 | 87.0 | 28,800 | 331 |
| SUBTOTAL COLD ROLLING: | | | | | | 240,000 | 4,623 |
| TEMPER ROLLING: | | | | | | | |
| LOW CARBON | IX | .007 | .00686 | 40.0 | 68.0 | 48,000 | 706 |
| LOW CARBON | IX | .010 | .0098 | 34.0 | 75.0 | 14,400 | 192 |
| DOUBLE COLD REDUCTION: | | | | | | | |
| DOUBLE PASS-TIN PLATE | | | | | | | |
| LOW CARBON | X | .013 | 3% | 41.4 | 100.8 | 74,400 | 738 |
| MEDIUM CARBON | X | .017 | 3% | 36.0 | 102.7 | 36,000 | 351 |
| HIGH CARBON | X | .022 | 3% | 27.8 | 90.9 | 24,000 | 264 |
| SUBTOTAL TEMPER ROLLING: | | | | | | 196,800 | 2,251 |
| SINGLE PASS-SHEET | | | | | | 436,800 | 6,874 |
| GRAND TOTAL: | | | | | | 457,515 | 7,200 |

The specific rolling schedules for each of the above-listed grades follows hereinafter.

For low carbon (0.10% carbon) steel beginning with an 80 inch outer diameter coil having a thickness of 0.07 inch and a width of 40 inches, the following rolling schedule is appropriate.

| | | | | | | |
|---|---|---|---|---|---|---|
| PASS NUMBER | 1 | 1 | 2 | 2 | 3 | 3 |
| ROLLING STAND | 1 | 2 | 2 | 1 | 1 | 2 |
| THICKNESS ENTRY | 0.0700 | 0.0455 | 0.0324 | 0.0221 | 0.0150 | 0.0102 |
| THICKNESS DELIVERY | 0.0455 | 0.0324 | 0.0221 | 0.0150 | 0.0102 | 0.0070 |
| SPEED CONE MIN.-FPM | 2249. | 2249. | 2249. | 2249. | 2249. | 2249. |
| SPEED CONE MAX.-FPM | 4498. | 4498. | 4498. | 4498. | 4498. | 4498. |
| MAX. OPERATING FPM | 4050. | 4050. | 4050. | 4050. | 4050. | 4050. |
| ROLLING FPM ENTRY | 1284. | 1976. | 1852. | 2715. | 1867. | 2745. |
| ROLLING FPM DELIVERY | 1976. | 2775. | 2715. | 4000. | 2745. | 4000. |
| BITE ANGLE DEGREES | 2.77 | 2.03 | 1.80 | 1.49 | 1.23 | 1.00 |
| % REDUCTION | 35.00 | 28.79 | 31.79 | 32.13 | 32.00 | 31.37 |
| TOTAL % REDUCTION | 35.00 | 53.71 | 68.43 | 78.57 | 85.43 | 90.00 |
| ENTRY STRIP LENGTH FT. | 3576. | 5501. | 7725. | 11326. | 16686. | 24539. |
| DELIVERY STRIP LENGTH FT. | 5501. | 7725. | 11326. | 16686. | 24539. | 35756. |
| PASS TIME MIN. | 2.78 | 2.78 | 4.17 | 4.17 | 8.94 | 8.94 |
| ENTRY TENSION LB. | 8800. | 25704. | 12000. | 12000. | 12000. | 8160. |
| DELIVERY TENSION LB. | 25704. | 14666. | 12000. | 12000. | 8160. | 2520. |
| ENTRY TENSION HP | 343. | 1539. | 673. | 987. | 679. | 679. |
| DELIVERY TENSION HP | 1539. | 1233. | 987. | 1455. | 679. | 305. |
| ENTRY STRESS PSI | 3143. | 14123. | 9259. | 13575. | 20000. | 20000. |
| DELIVERY STRESS PSI | 14123. | 11316. | 13575. | 20000. | 20000. | 9000. |
| LB./IN. WIDTH | 41918. | 45023. | 52324. | 50737. | 55950. | 80123. |
| SEP. FORCE LB. | 1676733. | 1800934. | 2092979. | 2029488. | 2237988. | 3204907. |
| WORK HP | 4498. | 4946. | 4351. | 4877. | 2698. | 3384. |
| TENSION HP | 1197. | −306. | 314. | 467. | 0. | −373. |
| BRG FRICTION HP | 134. | 202. | 230. | 328. | 248. | 518. |
| CONTACT WR-BU HP | 252. | 394. | 483. | 679. | 539. | 1347. |
| REQD NET HP | 3687. | 5848. | 4749. | 5417. | 3485. | 5622. |

In the above illustrated Example, the first pass can be completed in 262 seconds, the second pass in 350 seconds and the third and final pass in 695 seconds which, together with a 10 second delay for the reverses, results in a total running time of 1,317 seconds. This corresponds to the product rate of 47 tons per hour at 100% capacity or 35 tons per hour at 75% capacity, as illustrated in the mill schedule discussed above.

For low carbon (0.10% carbon) steel having a coil of 80 inch outer diameter, with a strip width of 41.4 and a strip thickness of 0.07 inches, the following rolling schedule is appropriate.

| | | | | | | |
|---|---|---|---|---|---|---|
| PASS NUMBER | 1 | 1 | 2 | 2 | 3 | 3 |
| ROLLING STAND | 1 | 2 | 2 | 1 | 1 | 2 |
| THICKNESS ENTRY | 0.0770 | 0.0539 | 0.0425 | 0.0316 | 0.0235 | 0.0174 |
| THICKNESS DELIVERY | 0.0539 | 0.0425 | 0.0316 | 0.0235 | 0.0174 | 0.0130 |
| SPEED CONE MIN.-FPM | 2249. | 2249. | 2249. | 2249. | 2249. | 2249. |
| SPEED CONE MAX.-FPM | 4498. | 4498. | 4498. | 4498. | 4498. | 4498. |
| MAX. OPERATING FPM | 4050. | 4050. | 4050. | 4050. | 4050. | 4050. |
| ROLLING FPM ENTRY | 1670. | 2385. | 2212. | 2975. | 2213. | 2989. |
| ROLLING FPM DELIVERY | 2385. | 3025. | 2975. | 4000. | 2989. | 4000. |
| BITE ANGLE DEGREES | 2.69 | 1.89 | 1.85 | 1.59 | 1.38 | 1.17 |
| % REDUCTION | 30.00 | 21.15 | 25.65 | 25.63 | 25.96 | 25.29 |
| TOTAL % REDUCTION | 30.00 | 44.81 | 58.96 | 69.48 | 77.40 | 83.12 |
| ENTRY STRIP LENGTH FT. | 3251. | 4644. | 5889. | 7921. | 10651. | 14385. |
| DELIVERY STRIP LENGTH FT. | 4644. | 5889. | 7921. | 10651. | 14385. | 19253. |
| PASS TIME MIN. | 1.95 | 1.95 | 2.66 | 2.66 | 4.81 | 4.81 |
| ENTRY TENSION LB. | 8800. | 28416 | 12000. | 12000. | 12000. | 8160. |
| DELIVERY TENSION LB. | 28416. | 14666. | 12000. | 12000. | 8160. | 2520. |
| ENTRY TENSION HP | 445. | 2054. | 804. | 1082. | 805. | 739. |
| DELIVERY TENSION HP | 2054. | 1344. | 1082. | 1455. | 739. | 305. |
| ENTRY STRESS PSI | 2761. | 12734. | 6820. | 9173. | 12334. | 11328. |
| DELIVERY STRESS PSI | 12734. | 8335. | 9173. | 12334. | 11328. | 4682. |
| LB./IN. WIDTH | 38300. | 38923. | 48062. | 47790. | 50222. | 55300. |
| SEP. FORCE LB. | 1585625. | 1611422. | 1989750. | 1978520. | 2079197. | 2289437. |
| WORK HP | 4987. | 4490. | 4735. | 5191. | 3293. | 3562. |
| TENSION HP | 1609. | −709. | 277. | 373. | −66. | −434. |

-continued

| | | | | | | |
|---|---|---|---|---|---|---|
| BRG FRICTION HP | 153. | 197. | 239. | 320. | 251. | 370. |
| CONTACT WR-BU HP | 275. | 357. | 482. | 642. | 517. | 799. |
| REQD NET HP | 3806. | 5753. | 5178. | 5780. | 4127. | 5165. |

In the above Example, the first pass can be completed in 206 seconds, the second in 253 seconds and the third in 442 seconds which, together with a 10 second delay for reversing the rolling direction, results in a 911 second total time. This corresponds to 70 tons per hour at 100% capacity or 52 tons per hour at 75% of capacity.

For medium carbon (0.20% carbon) steel having a coil of 80 inch outer diameter, with a width of 36 inches and an entry thickness of 0.07, the following rolling schedule is appropriate.

| | | | | |
|---|---|---|---|---|
| PASS NUMBER | 1 | 1 | 2 | 2 |
| ROLLING STAND | 1 | 2 | 2 | 1 |
| THICKNESS ENTRY | 0.0740 | 0.0488 | 0.0354 | 0.0245 |
| THICKNESS DELIVERY | 0.0488 | 0.0354 | 0.0245 | 0.0170 |
| SPEED CONE MIN.-FMP | 2249. | 2249. | 2249. | 2249. |
| SPEED CONE MAX.-FPM | 4498. | 4498. | 4498. | 4498. |
| MAX. OPERATING FPM | 4050. | 4050. | 4050. | 4050. |
| ROLLING FPM ENTRY | 1191. | 1806. | 1532. | 2213. |
| ROLLING FPM DELIVERY | 1806. | 2490. | 2213. | 3190. |
| BITE ANGLE DEGREES | 2.81 | 2.05 | 1.85 | 1.53 |
| % REDUCTION | 34.05 | 27.46 | 30.79 | 30.61 |
| TOTAL % REDUCTION | 34.05 | 52.16 | 66.89 | 77.03 |
| ENTRY STRIP LENGTH FT. | 3382. | 5129. | 7070. | 10216. |
| DELIVERY STRIP LENGTH FT. | 5129. | 7070. | 10216. | 14723. |
| PASS TIME MIN. | 2.84 | 2.84 | 4.62 | 4.62 |
| ENTRY TENSION LB. | 8800. | 22000. | 12000. | 12000. |
| DELIVERY TENSION LB. | 22000. | 12000. | 12000. | 5000. |
| ENTRY TENSION HP | 318. | 1204. | 557. | 805. |
| DELIVERY TENSION HP | 1204. | 905. | 805. | 483. |
| ENTRY STRESS PSI | 3303. | 12523. | 9416. | 13605. |
| DELIVERY STRESS PSI | 12523. | 9416. | 13605. | 8170. |
| LB./IN. WIDTH | 54950. | 58051. | 66876. | 71124. |
| SEP. FORCE LB. | 1978201. | 2089836. | 2407545. | 2560454. |
| WORK HP | 4752. | 4816. | 3976. | 4568. |
| TENSION HP | 887. | −299. | 248. | −322. |
| BRG FRICTION HP | 144. | 210. | 215. | 330. |
| CONTACT WR-BU HP | 311. | 465. | 512. | 809. |
| REQD NET HP | 4321. | 5791. | 4455. | 6029. |

In the above Example, the first pass can be completed in 261 seconds with the second pass in 431 seconds including delays which results in a 692 second running time. This equates to 80 tons per hour at 100% capacity or 60 tons per hour at 75% capacity, as illustrated on the milling schedule.

A high carbon (0.35% carbon) steel coil having a strip width of 27.8 inches and entry thickness of 0.78 inch and an outer coil diameter of 80 inches is rolled as follows.

| | | | | |
|---|---|---|---|---|
| PASS NUMBER | 1 | 1 | 2 | 2 |
| ROLLING STAND | 1 | 2 | 2 | 1 |
| THICKNESS ENTRY | 0.0780 | 0.0568 | 0.0414 | 0.0301 |
| THICKNESS DELIVERY | 0.0568 | 0.0414 | 0.0301 | 0.0220 |

-continued

| | | | | |
|---|---|---|---|---|
| SPEED CONE MIN.-FMP | 2249. | 2249. | 2249. | 2249. |
| SPEED CONE MAX.-FPM | 4498. | 4498. | 4498. | 4498. |
| MAX. OPERATING FPM | 4050. | 4050. | 4050. | 4050. |
| ROLLING FPM ENTRY | 1449. | 1990. | 1807. | 2485. |
| ROLLING FPM DELIVERY | 1990. | 2730. | 2485. | 3400. |
| BITE ANGLE DEGREES | 2.58 | 2.20 | 1.88 | 1.59 |
| % REDUCTION | 27.18 | 27.11 | 27.29 | 26.91 |
| TOTAL % REDUCTION | 27.18 | 46.92 | 61.41 | 71.79 |
| ENTRY STRIP LENGTH FT. | 3209. | 4407. | 6046. | 8315. |
| DELIVERY STRIP LENGTH FT. | 4407. | 6046. | 8315. | 11377. |
| PASS TIME MIN. | 2.21 | 2.21 | 3.35 | 3.35 |
| ENTRY TENSION LB. | 8800. | 21317. | 14666. | 11296. |
| DELIVERY TENSION LB. | 21317. | 14666. | 11296. | 5504. |
| ENTRY TENSION HP | 386. | 1285. | 803. | 851. |
| DELIVERY TENSION HP | 1285. | 1213. | 851. | 567. |
| ENTRY STRESS PSI | 4058. | 13500. | 12743. | 13499. |
| DELIVERY STRESS PSI | 13500. | 12743. | 13499. | 8999. |
| LB./IN. WIDTH | 59189. | 69716. | 78604. | 86446. |
| SEP. FORCE LB. | 1645448. | 1938101. | 2185182. | 2403209. |
| WORK HP | 3871. | 5189. | 4050. | 4539. |
| TENSION HP | 899. | −72. | 48. | −284. |
| BRG FRICTION HP | 132. | 214. | 219. | 330. |
| CONTACT WR-BU HP | 296. | 519. | 565. | 892. |
| REQD NET HP | 3400. | 5994. | 4786. | 6044. |

In the above Example, the first pass can be completed in 221 seconds with the second pass completed in 352 seconds for a total running time of 573 seconds. This results in 74 tons per hour at 100% capacity which when reduced to 75% capacity is 56 tons per hour, as illustrated on the milling schedule.

An alloy steel (0.50% carbon) having an entrance thickness of 0.094 inch, a strip width of 30.8 inches and an outer diameter of coil of 80 inches will roll according to the following schedule.

| | | | | |
|---|---|---|---|---|
| PASS NUMBER | 1 | 1 | 2 | 2 |
| ROLLING STAND | 1 | 2 | 2 | 1 |
| THICKNESS ENTRY | 0.0940 | 0.0690 | 0.0573 | 0.0448 |
| THICKNESS DELIVERY | 0.0690 | 0.0573 | 0.0448 | 0.0350 |
| SPEED CONE MIN.-FMP | 2249. | 2249. | 2249. | 2249. |
| SPEED CONE MAX.-FPM | 4498. | 4498. | 4498. | 4498. |
| MAX. OPERATING FPM | 4050. | 4050. | 4050. | 4050. |
| ROLLING FPM ENTRY | 1664. | 2267. | 1484. | 1898. |
| ROLLING FPM DELIVERY | 2267. | 2730. | 1898. | 2430. |
| BITE ANGLE DEGREES | 2.80 | 1.91 | 1.98 | 1.75 |
| % REDUCTION | 26.60 | 16.96 | 21.82 | 21.87 |
| TOTAL % REDUCTION | 26.60 | 39.04 | 52.34 | 62.77 |

-continued

| | | | | |
|---|---|---|---|---|
| ENTRY STRIP LENGTH FT. | 2663. | 3627. | 4368. | 5587. |
| DELIVERY STRIP LENGTH FT. | 3627. | 4368. | 5587. | 7151. |
| PASS TIME MIN. | 1.60 | 1.60 | 2.94 | 2.94 |
| ENTRY TENSION LB. | 8800. | 30519. | 8800. | 18627. |
| DELIVERY TENSION LB. | 30519. | 14666. | 18627. | 9702. |
| ENTRY TENSION HP | 444. | 2097. | 396. | 1072. |
| DELIVERY TENSION HP | 2097. | 1213. | 1072. | 714. |
| ENTRY STRESS PSI | 3040. | 14361. | 4986. | 13499. |
| DELIVERY STRESS PSI | 14361. | 8310. | 13499. | 9000. |
| LB./IN. WIDTH | 74247. | 71959. | 90795. | 97182. |
| SEP. FORCE LB. | 2286798. | 2216350. | 2796500. | 2993196. |
| WORK HP | 6509. | 4812. | 3921. | 4532. |
| TENSION HP | 1653. | −883. | 676. | −357. |
| BRG FRICTION HP | 209. | 244. | 214. | 294. |
| CONTACT WR-BU HP | 524. | 603. | 594. | 842. |
| REQD NET HP | 5590. | 6542. | 4054. | 6025. |

In the above Example, the first pass can be completed in 180 seconds with the second pass completed in 319 seconds resulting in a total running time of 499 seconds for cold rolling of this coil. This corresponds to 94 tons per hour capacity at 100% or at 71 tons per hour capacity at 75%, as illustrated on the schedule.

The cold rolling of a steel coil having 3.18% silicon with an 80 inch outer diameter, a 37 inch width and an entry thickness of 0.113 inch can be accomplished according to the following schedule.

| | | | | |
|---|---|---|---|---|
| PASS NUMBER | 1 | 1 | 2 | 2 |
| ROLLING STAND | 1 | 2 | 2 | 1 |
| THICKNESS ENTRY | 0.1130 | 0.0870 | 0.0744 | 0.0587 |
| THICKNESS DELIVERY | 0.0870 | 0.0744 | 0.0587 | 0.0490 |
| SPEED CONE MIN.-FMP | 2249. | 2249. | 2249. | 2249. |
| SPEED CONE MAX.-FPM | 4498. | 4498. | 4498. | 4498. |
| MAX. OPERATING FPM | 4050. | 4050. | 4050. | 4050. |
| ROLLING FPM ENTRY | 1603. | 2082. | 1498. | 1899. |
| ROLLING FPM DELIVERY | 2082. | 2435. | 1899. | 2275. |
| BITE ANGLE DEGREES | 2.86 | 1.99 | 2.22 | 1.74 |
| % REDUCTION | 23.01 | 14.48 | 21.10 | 16.52 |
| TOTAL % REDUCTION | 23.01 | 34.16 | 48.05 | 56.64 |
| ENTRY STRIP LENGTH FT. | 2215. | 2877. | 3364. | 4264. |
| DELIVERY STRIP LENGTH FT. | 2877. | 3364. | 4264. | 5108. |
| PASS TIME MIN. | 1.38 | 1.38 | 2.25 | 2.25 |
| ENTRY TENSION LB. | 8800. | 25419. | 14666. | 26773. |
| DELIVERY TENSION LB. | 25419. | 14666. | 26773. | 14666. |
| ENTRY TENSION HP | 428. | 1604. | 666. | 1541. |
| DELIVERY TENSION HP | 1604. | 1082. | 1541. | 1011. |
| ENTRY STRESS PSI | 2105. | 7897. | 5328. | 12327. |
| DELIVERY STRESS PSI | 7897. | 5328. | 12327. | 8089. |
| LB./IN. WIDTH | 65914. | 62562. | 82184. | 81353. |
| SEP. FORCE LB. | 2438803. | 2314798. | 3040797. | 3010077. |
| WORK HP | 6620. | 4724. | 5211. | 4469. |
| TENSION HP | 1176. | −522. | 875. | −530. |
| BRG FRICTION HP | 205. | 228. | 233. | 277. |
| CONTACT WR-BU HP | 484. | 523. | 615. | 725. |
| REQD NET HP | 6133. | 5997. | 5184. | 6000. |

In the above Example, the first pass can be completed in 163 seconds while the second pass can be completed in 274 seconds resulting in a total running time for this coil of 437 seconds. This corresponds to 130 tons per hour of production at 100% capacity or 98 tons per hour at 75% capacity.

A ferritic stainless steel having an entry thickness of 0.113 inch, a width of 33 inches and a coil outer diameter of 80 inches can be cold rolled according to the following schedule.

| | | | | |
|---|---|---|---|---|
| PASS NUMBER | 1 | 1 | 2 | 2 |
| ROLLING STAND | 1 | 2 | 2 | 1 |
| THICKNESS ENTRY | 0.1130 | 0.0870 | 0.0720 | 0.0575 |
| THICKNESS DELIVERY | 0.0870 | 0.0720 | 0.0575 | 0.0460 |
| SPEED CONE MIN.-FMP | 2249. | 2249. | 2249. | 2249. |
| SPEED CONE MAX.-FPM | 4498. | 4498. | 4498. | 4498. |
| MAX. OPERATING FPM | 4050. | 4050. | 4050. | 4050. |
| ROLLING FPM ENTRY | 1552. | 2015. | 1661. | 2080. |
| ROLLING FPM DELIVERY | 2015. | 2435. | 2080. | 2600. |
| BITE ANGLE DEGREES | 2.86 | 2.17 | 2.13 | 1.90 |
| % REDUCTION | 23.01 | 17.24 | 20.14 | 20.00 |
| TOTAL % REDUCTION | 23.01 | 36.28 | 49.12 | 59.29 |
| ENTRY STRIP LENGTH FT. | 2215. | 2877. | 3476. | 4353. |
| DELIVERY STRIP LENGTH FT. | 2877. | 3476. | 4353. | 5441. |
| PASS TIME MIN. | 1.43 | 1.43 | 2.09 | 2.09 |
| ENTRY TENSION LB. | 8800. | 26789. | 8800. | 26789. |
| DELIVERY TENSION LB. | 26789. | 14666. | 26789. | 14666. |
| ENTRY TENSION HP | 414. | 1636. | 443. | 1689. |
| DELIVERY TENSION HP | 1636. | 1082. | 1689. | 1156. |
| ENTRY STRESS PSI | 2360. | 9331. | 3704. | 14118. |
| DELIVERY STRESS PSI | 9331. | 6173. | 14118. | 9661. |
| LB./IN. WIDTH | 59540. | 57988. | 65614. | 65903. |
| SEP. FORCE LB. | 1964806. | 1913604. | 2165267. | 2174808. |
| WORK HP | 5256. | 4564. | 4004. | 4553. |
| TENSION HP | 1222. | −554. | 1246. | −533. |
| BRG FRICTION HP | 160. | 188. | 182. | 228. |
| CONTACT WR-BU HP | 359. | 417. | 428. | 539. |
| REQD NET HP | 4552. | 5723. | 3368. | 5853. |

In the above Example, the first pass can be completed in 167 seconds while the second pass can be completed in 268 seconds resulting in a 435 second total running time. This corresponds to 116 tons per hour of production at 100% capacity or 87 tons per hour at 75% capacity.

The temper rolling schedules of some of the above-listed products are as follows, with the first Example corresponding to the listed grades of low carbon steel (0.10% carbon) and the second Example representing a double cold reduction of various products having a temper reduction of 3%.

| MATERIAL | LOW CARBON | LOW CARBON | LOW CARBON | LOW CARBON |
|---|---|---|---|---|
| PASS NUMBER | 1 | 1 | 1 | 1 |
| ROLLING STAND | 1 | 2 | 1 | 2 |
| THICKNESS ENTRY | 0.0070 | 0.0069 | 0.0100 | 0.0098 |
| THICKNESS DELIVERY | 0.0069 | 0.0069 | 0.0098 | 0.0098 |
| SPEED CONE MIN.-FMP | 2249. | 2249. | 2249. | 2249. |
| SPEED CONE MAX.-FPM | 4498. | 4498. | 4498. | 4498. |
| MAX. OPERATING FPM | 4050. | 4050. | 4050. | 4050. |
| ROLLING FPM ENTRY | 3969. | 4029. | 3969. | 4029. |

-continued

| MATERIAL | LOW CARBON | LOW CARBON | LOW CARBON | LOW CARBON |
|---|---|---|---|---|
| ROLLING FPM DELIVERY | 4029. | 4050. | 4029. | 4050. |
| BITE ANGLE DEGREES | 0.18 | 0.10 | 0.22 | 0.13 |
| % REDUCTION | 1.50 | 0.51 | 1.50 | 0.51 |
| TOTAL % REDUCTION | 1.50 | 2.00 | 1.50 | 2.00 |
| ENTRY STRIP LENGTH FT. | 35756. | 36301. | 25029. | 25411. |
| DELIVERY STRIP LENGTH FT. | 36301. | 36486. | 25411. | 25540. |
| PASS TIME MIN. | 9.01 | 9.01 | 6.31 | 6.31 |
| ENTRY TENSION LB. | 2716. | 3000. | 2761. | 3000. |
| DELIVERY TENSION LB. | 3000. | 2716. | 3000. | 2716. |
| ENTRY TENSION HP | 327. | 366. | 327. | 366. |
| DELIVERY TENSION HP | 366. | 333. | 366. | 333. |
| ENTRY STRESS PSI | 9700. | 10877. | 7988. | 8958. |
| DELIVERY STRESS PSI | 10877. | 9898. | 8958. | 8151. |
| LB./IN. WIDTH | 2708. | 2695. | 3008. | 2879. |
| SEP. FORCE LB. | 108312. | 107808. | 102272. | 97883. |
| WORK HP | 24. | 9. | 28. | 10. |
| TENSION HP | 40. | −33. | 40. | −33. |
| BRG FRICTION HP | 18. | 18. | 17. | 16. |
| CONTACT WR-BU HP | 8. | 8. | 8. | 8. |
| REQD NET HP | 10. | 68. | 14. | 67. |

ordinary skill in the art that various modifications may be made to the present invention without departing from the spirit and scope thereof. Consequently, the scope of the present invention should be defined by the following claims.

What is claimed is:

1. A method of cold rolling substantially homogeneous metal band comprising the steps of:

a) providing a cold reduction mill having at least two four-high reversing stands for operation in tandem, at least one tension reel on a first side of said stands, and at least one tension reel on a second side of said stands;

b) passing said metal band in a first pass from one of said at least one tension reel on said first side through said tandem stands to one of said at least one tension reel on said second side, wherein each said tandem stand reduces said metal band on said first pass whereby said stands operate in tandem during said first pass; and c) passing said metal band in a consecutive second pass from one of said at least one tension reel on said second side through said stands to one of said at least one tension reel on said first side wherein each said tandem mill stand reduces said metal band on said second pass whereby said stands operate in tandem during said second pass.

2. The method of claim 1 further including the step of:

d) repeating step b) for a third pass.

3. The method of claim 1 wherein step b) reduces said metal band by at least one-third.

4. The method of claim 1 wherein steps b) and c) reduce said metal band at least 50%.

| MATERIAL | LOW CARBON | MEDIUM CARBON | HIGH CARBON |
|---|---|---|---|
| WORK ROLL DIAMETER (IN.) | 21.00 | 21.00 | 21.00 |
| ENTRY YIELD STRENGTH (PSI) | 35000. | 51000. | 61000. |
| COEFFICIENT OF FRICTION | 0.300 | 0.300 | 0.300 |
| ENTRY THICKNESS OF STRIP (IN.) | 0.01300 | 0.01700 | 0.02200 |
| DELIVERY THICKNESS OF STRIP (IN.) | 0.01261 | 0.01649 | 0.02134 |
| r REDUCTION (RATIO DRAFT TO ENTRY THICKNESS) | 0.03000 | 0.03000 | 0.03000 |
| REDUCTION (%) | 3.00 | 3.00 | 3.00 |
| MATERIAL WIDTH (IN.) | 41.40 | 36.00 | 27.80 |
| ENTRY STRIP SPEED (FPM) | 3929. | 3929. | 3929. |
| DELIVERY STRIP SPEED (FPM) | 4050. | 4050. | 4050. |
| ENTRY BRIDLE TENSION (LB.) | 4655. | 7448. | 12103. |
| DELIVERY BRIDLE TENSION (LB.) | 4655. | 7448. | 12103. |
| ENTRY BRIDLE TENSION (PSI) | 8649. | 12170. | 19789. |
| DELIVERY BRIDLE TENSION (PSI) | 8917. | 12546. | 20401. |
| ARC OF CONTACT LENGTH (IN.) | 0.1260 | 0.13436 | 0.14297 |
| AVERAGE STRAIN RATE (IN./IN./SEC.) | 191.65 | 180.86 | 169.96 |
| COMPRESSIVE STRESS REQD TO DEFORM STRIP (PSI) | 74619. | 90430. | 100228. |
| CONSTRAINED YIELD STRENGTH IN COMPRESSION (PSI) | 86185. | 104447. | 115763. |
| AVERAGE STRIP TENSION IN ROLL BITE (PSI) | 8783. | 12358. | 20095. |
| SPECIFIC ROLLING FORCE (LB./IN. OF WIDTH) | 63185. | 53264. | 43979. |
| SEPARATING FORCE (LB.) | 2615854. | 1917520. | 1222622. |
| SPECIFIC TOTAL TORQUE (LB.-IN.) | 51518. | 59845. | 54364. |
| ROLLING HORSEPOWER REQD (HP) | 602. | 700. | 636. |
| TENSION HORSEPOWER (HP) | 17. | 27. | 45. |
| BEARING FRICTION HORSEPOWER (HP) | 428. | 314. | 200. |
| CONTACT LOSS WR-BU HORSEPOWER (HP) | 593. | 399. | 231. |
| REQD NET HORSEPOWER (HP) | 1606. | 1385. | 1022. |
| ENTRY DRAG BRIDLE HORSEPOWER REQD (HP) | 554. | 887. | 1441. |
| DELIVERY BRIDLE HORSEPOWER REQD (HP) | 571. | 914. | 1485. |
| ENTRY BRIDLE (LB. PULL/IN. OF WIDTH) | 112. | 207. | 435. |
| DELIVERY BRIDLE (LB. PULL/IN. OF WIDTH) | 112. | 207. | 435. |
| CYCLE TIME (MIN.) | 7.86 | 6.70 | 5.85 |
| TONS/HOUR @ 75% EFFICIENCY | 100.8 | 102.7 | 90.9 |

While the preferred embodiments of the present invention has been described in detail, it will be obvious to those of 5. The method of claim 1 wherein a pair of reels is provided on said first side of said stands, wherein a first of said pair of reels is utilized in step b) and a second of said pair of reels is utilized in step c).

6. The method of claim 1 wherein steps b) and c) are repeated for a mix of metal products.

7. The method of claim 1 wherein a significant entry tension in a first and a second of said at least two four-high reversing stands is maintained on said metal band in steps b) and c).

8. The method of claim 1 wherein step c) is performed on said metal band about 10 seconds after step b).

9. The method of claim 1 wherein said metal band is a steel coil having silicone, and steps a) and b) are performed in less than about 450 seconds.

10. The method of claim 1 wherein in each said pass said metal band is passed directly from a first one of said stands to a second one of said stands.

11. The method of claim 2 wherein steps b) through d) reduce said metal band at least 80%.

12. The method of claim 6 wherein said product mix includes low carbon steel, medium carbon steel, high carbon steel, alloy, Si steel and stainless steel.

13. The method of claim 6 wherein steps b) and c) will reduce each said product of said product mix between 55% and 80%.

14. The method according to claim 6 wherein each said four-high stand is adapted for temper rolling each of said metal bands, said method further comprising the step of:

passing a strip of metal of said product mix through said stands for a temper pass whereby said stands reduce said strip by less than 10%.

15. The method of claim 14 wherein said temper pass reduces said metal band up to 3%.

16. The method of claim 14 wherein a bridle roll unit is provided on each side of said reversing stands wherein said metal band is passed through said bridle roll units on said temper pass.

17. The method of claim 14 wherein said temper pass is repeated for each said product of said product mix.

18. The method of claim 17 wherein said tandem mill cold rolls about 240,000 tons of said product mix in between about 4,500 and 4,700 hours and said tandem mill temper rolls about 195,000 tons in between about 2,200 and 2,300 hours.

19. The method of claim 7 wherein said entry tension is greater than or equal to 8,800 pounds.

20. A tandem, reversing cold rolling and temper mill comprising:

at least two tandem four-high reversing stands;

at least one tension reel on a first side of said stands for paying off and receiving a strip of metal to and from said stands;

at least one tension reel on a second side of said stands receiving and paying off a strip of metal from and to said tandem, reversing stands; and a bridle roll unit positioned on each side of said stands between said mills and said tension reels.

21. The tandem, reversing cold rolling and temper mill of claim 20 further comprising:

two tension reels on said first side of said tandem, reversing stands.

22. The tandem, reversing cold rolling and temper mill of claim 21 further comprising:

a dividing shear on said first side between said tandem, reversing mills and said bridle unit.

23. The tandem, reversing cold rolling and temper mill of claim 22 wherein each said reversing mill stand includes a pair of working rolls each having a diameter of about 19–21 inches and a pair of backing rolls each having a diameter of about 49–53 inches.

24. The tandem, reversing cold rolling and temper mill of claim 23 wherein each said working and backup roll of each said reversing mill has a width of about 56 inches.

25. A method of cold rolling hot mill band and temper rolling cold reduced and annealed coils comprising the steps of:

a) providing at least two four-high reversing mill stands for operation in tandem, at least one tension reel on a first side of said tandem mill, and at least one tension reel on a second side of said tandem mill;

b) rolling a first campaign of hot mill band back and forth through the stands in a reversing mode between said tension reels to achieve a predetermined thickness for said product;

c) converting said tandem mills into a temper mill mode; and d) passing a campaign of cold reduced and annealed steel through at least one of said mills in a temper mode.

* * * * *